US006669056B2

(12) United States Patent
Bistolfi

(10) Patent No.: US 6,669,056 B2
(45) Date of Patent: Dec. 30, 2003

(54) FOAMING DEVICE

(75) Inventor: Maurizio Bistolfi, San Giuliano Vecchio (IT)

(73) Assignee: Guala Dispensing, S.p.A., Alessandria (IT)

( * ) Notice: Subject to any disclaimer, the term of this patent is extended or adjusted under 35 U.S.C. 154(b) by 0 days.

(21) Appl. No.: 10/191,555

(22) Filed: Jul. 10, 2002

(65) Prior Publication Data

US 2003/0015552 A1 Jan. 23, 2003

(30) Foreign Application Priority Data

Jul. 17, 2001 (EP) ..... 01830472

(51) Int. Cl.[7] ..... B67D 5/60

(52) U.S. Cl. ..... 222/145.6; 222/145.1; 222/145.7; 222/209; 222/213; 222/321.6; 222/321.7; 222/321.8; 222/321.9

(58) Field of Search ..... 222/129, 145.1, 222/145.6, 145.5, 145.7, 190, 207, 209, 212, 213, 215, 321.1, 321.6, 321.7–321.9; 239/329, 330

(56) References Cited

U.S. PATENT DOCUMENTS 3,161,329 A 12/1964 Fedit et al.
3,387,789 A 6/1968 Fedit et al.
4,347,953 A 9/1982 Bauer
4,771,925 A 9/1988 Stoffler et al.
4,880,161 A * 11/1989 Wright ..... 239/330
4,957,218 A * 9/1990 Ford, Jr. ..... 222/1
5,289,952 A * 3/1994 Gueret ..... 222/190
5,326,000 A * 7/1994 Fuchs ..... 222/321.7
5,462,208 A * 10/1995 Stahley et al. ..... 222/207
5,518,147 A 5/1996 Peterson et al.

FOREIGN PATENT DOCUMENTS

GB 193523 2/1923
JP 09-001009 6/1995

* cited by examiner

*Primary Examiner*—Timothy L. Maust
(74) *Attorney, Agent, or Firm*—Dickstein Shapiro Morin & Oshinsky, LLP

(57) ABSTRACT

A foaming device, capable of generating foam by mixing a volume of air with a quantity of liquid, optionally connected to a tank of the liquid and provided with valves for controlling the flow of air and liquid, comprises an air chamber enclosed in a resiliently deformable diaphragm, and a liquid chamber. The diaphragm is shaped in such a way as to produce an increasing rate of flow of expelled air during deformation by an air piston.

58 Claims, 7 Drawing Sheets

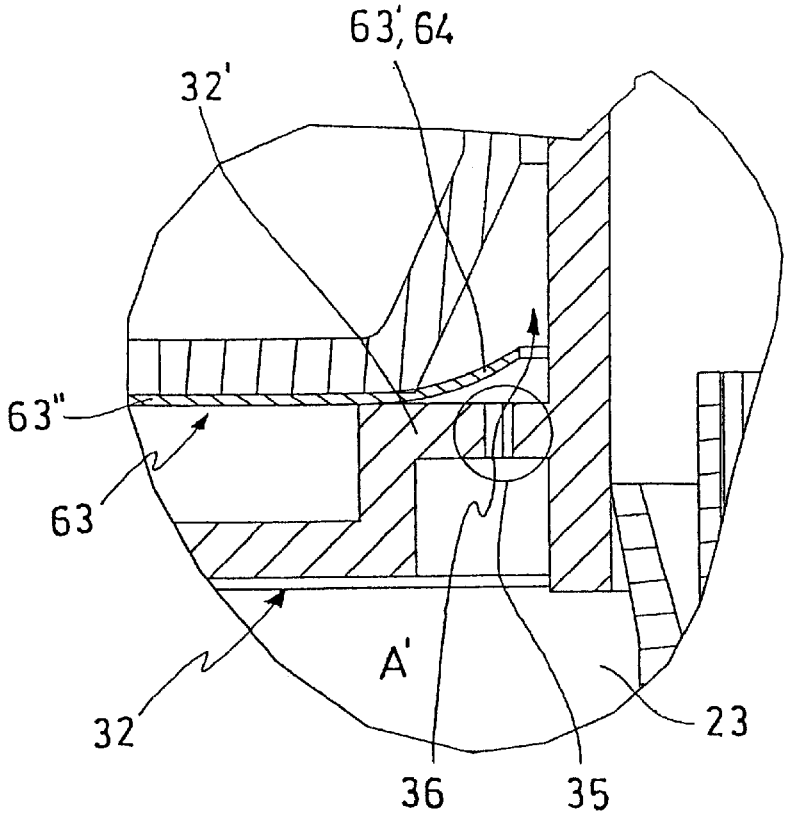
FIG.4
FIG.5
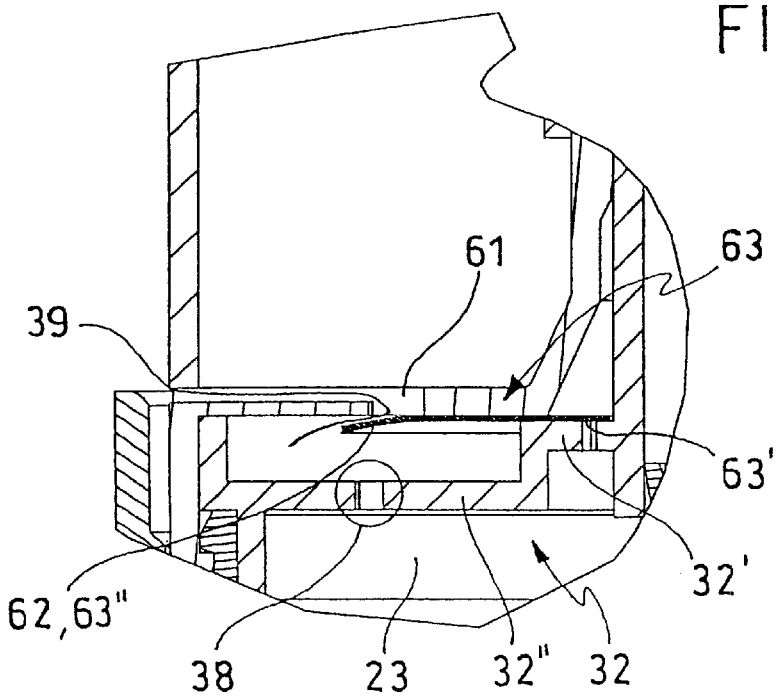

FIG.6
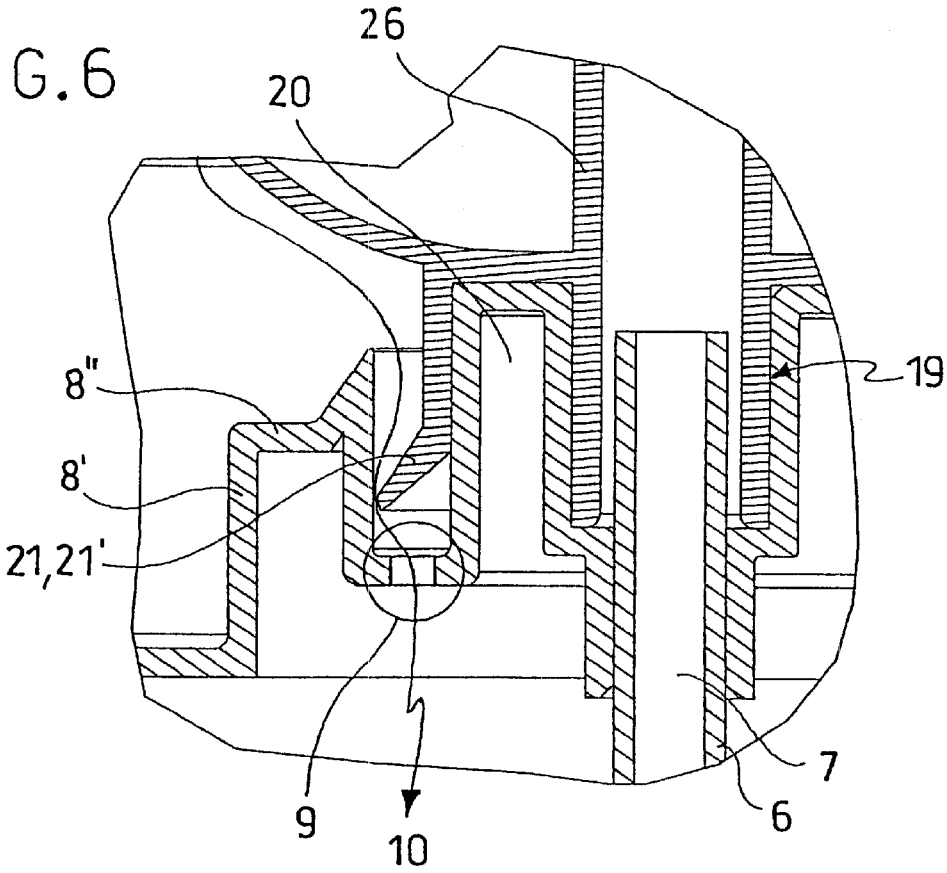
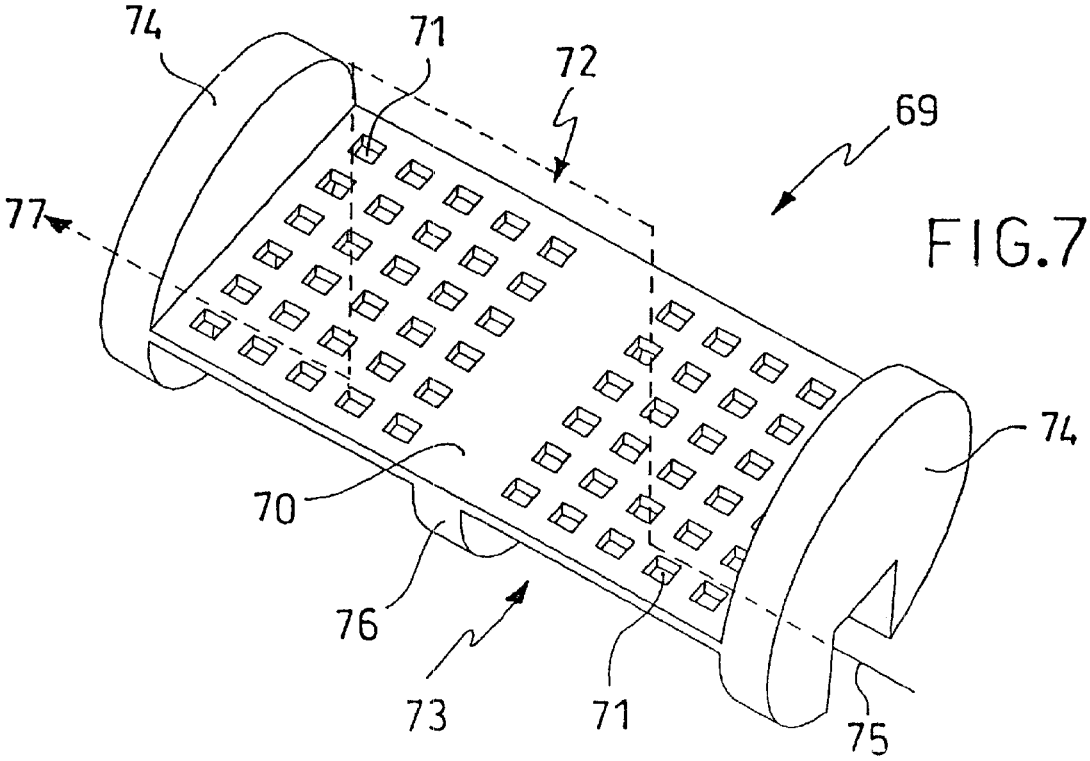
FIG.7

FOAMING DEVICE

FIELD OF THE INVENTION

The present invention relates to a foaming device capable of generating foam by mixing a quantity of liquid with a volume of air, in accordance with the preamble of claim 1.

BACKGROUND OF THE INVENTION

It is known that in the field of devices for generating foam by mixing a foam-generating liquid with air, the need to optimize foam formation is increasingly felt.

One solution currently used in the field of foam-generating devices, particularly devices using two pumping members (one for expelling a quantity of liquid and the other for compressing and expelling a volume of air), requires that the said devices be produced in such a way that they expel a constant rate of flow of air during the escape of the foam.

In this context, "rate of flow of air" means the variation in the volume of air expelled as a function of the displacement of an air piston which deforms (compresses) the chamber in which the air to be expelled is contained.

The above solution has the disadvantage of expelling an airflow that does not completely mix with the liquid. In other words, at the beginning of the compression of the device, the airflow that invests the liquid is too great for the available liquid.

An example of a foam-generating device with an air chamber enclosed in a compressible bellows (shaped appropriately to ensure the escape of the air in a constant air/liquid ratio) is disclosed in U.S. Pat. No. 5,462,208.

SUMMARY OF THE INVENTION

The present invention addresses the problem of devising a foaming device that has structural and functional characteristics such as to satisfy the abovementioned requirements and at the same time obviate the problems discussed with reference to the prior art.

This problem is solved with a foaming device in accordance with claim 1, capable of generating foam by mixing a quantity of liquid with a volume of air.

Further characteristics, and the advantages, of the device according to the present invention will become clear in the following description of a preferred embodiment thereof.

BRIEF DESCRIPTION OF THE DRAWINGS

The description is given by way of non-limiting guidance, with reference to the accompanying figures, in which:

FIG. 4 shows detail A from the device of FIG. 3, enlarged and in a deformed condition assumed during expulsion of air;

FIG. 5 shows detail B from the device of FIG. 3, enlarged and in a deformed condition during aspiration of air;

FIG. 6 shows detail C from the device of FIG. 3, enlarged and in a deformed condition during aspiration of air;

FIG. 7 shows an enlarged perspective view of a foaming member;

DETAILED DESCRIPTION

Figure 1:
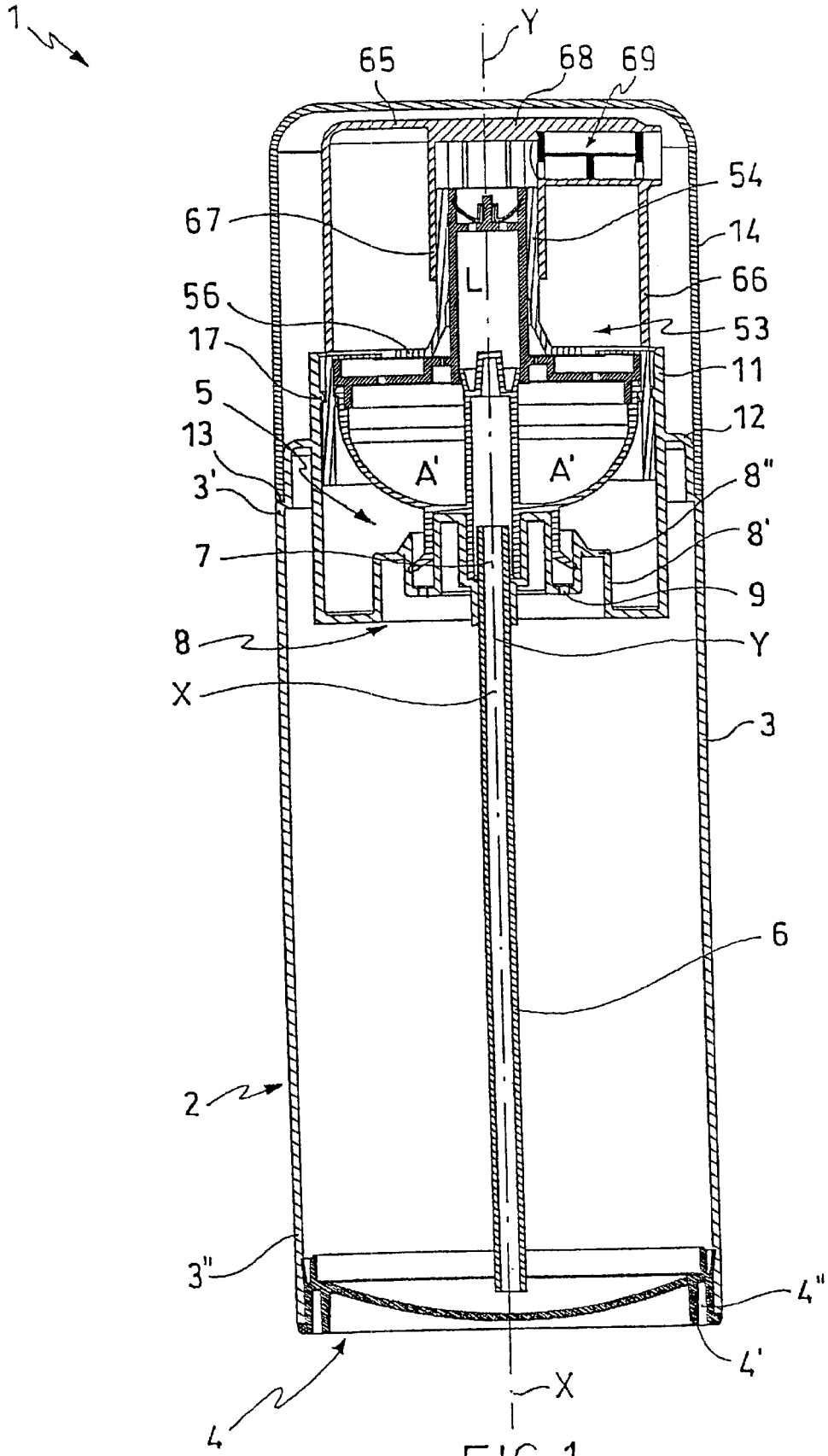
FIG. 1 shows a cross section through a foaming device fitted to a tank and with a cap.

The number 1 refers to a foaming device capable of generating foam by mixing a volume of air A' with a quantity of liquid L'.

The device 1 can be fitted to a tank 2 designed to contain the liquid L during transportation and during use of the device 1, thus ensuring that it is not lost or contaminated with dust or the like.

The tank 2 is bounded by essentially cylindrical side walls 3 that extend along an axis of symmetry X—X, from an upper end 3' to a lower end 3" . At the said lower end 3", the tank 2 is provided with a bottom 4, while at the upper end 3' it is provided with closing means 5.

The bottom 4, of deformable resilient material, is fitted removably to the tank 2 and is roughly dish-shaped. The said bottom 4 also includes a gripping lip 4' in the form of a cylindrical wall which, together with the outermost wall of the bottom 4, provides a gripping space 4".

Near the bottom 4, on the inside of the tank, is one end of an aspiration tube 6, the other end of which fits inside an aperture 7 formed in the closing means 5 of the tank 2.

At the upper end 3' of the tank 2, the closing means 5 comprise a base 8 shaped as a series of vertical cylindrical walls 8' and annuluses 8" which give it a conical profile.

The base 8 is pierced by a plurality of holes 9 that allow communication between the tank 2 and the external environment via a renewing pass 10 (in FIG. 2) whereby the air in the tank 2 is renewed.

The closing means 5 also include a containment cylinder 11 integral with the base 8 and forming one piece with the side wall 3 of the tank 2, to which it is connected by a shoulder surface 12 of curvilinear sections. Internally, the said containment cylinder 11 has an essentially annular stop edge 17.

Where the shoulder surface 12 meets the side walls 3 of the tank it forms a supporting ledge 13 to support a cap 14, which can be placed on the device 1 when the said device 1 is not likely to be used.

Figure 2:
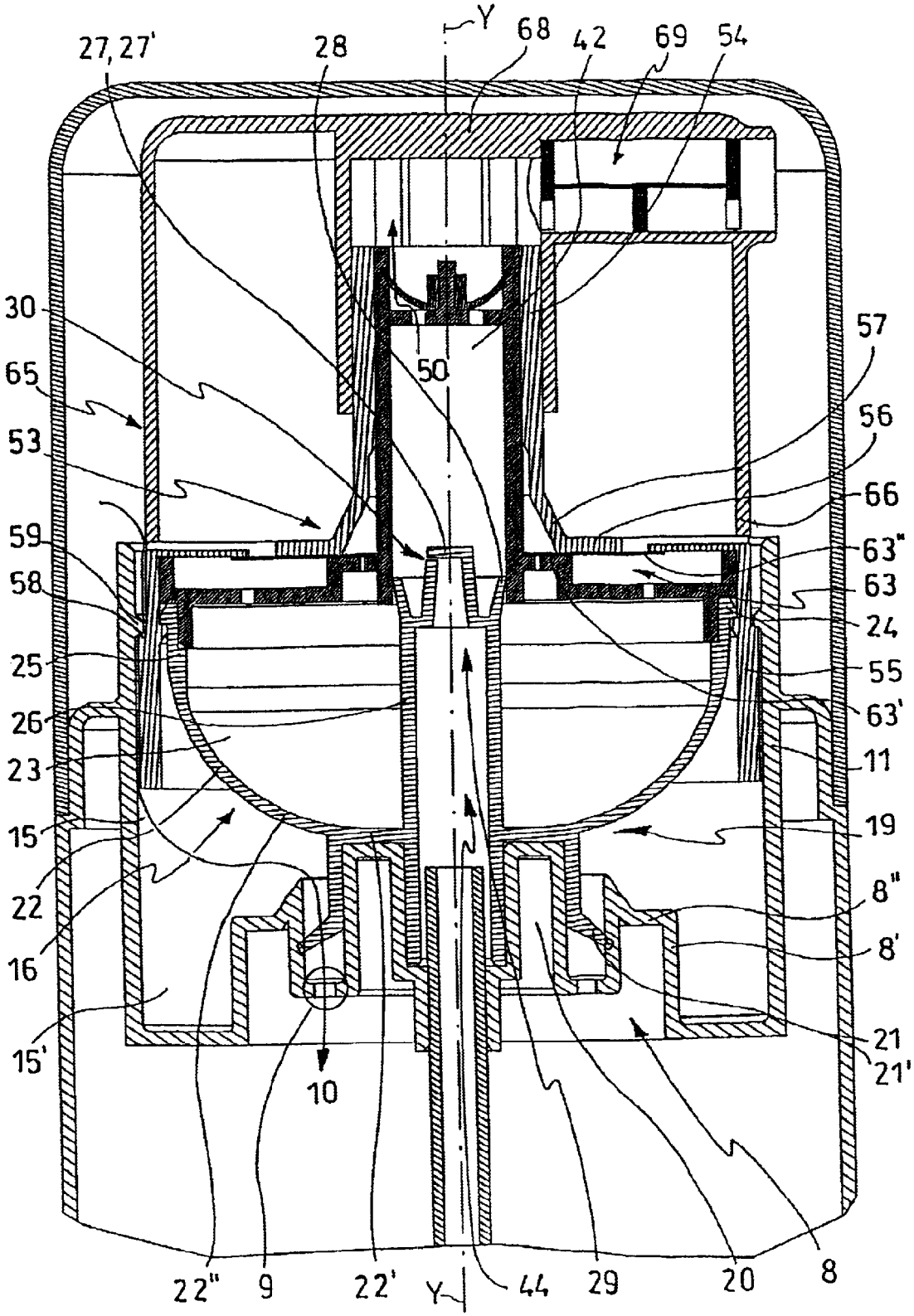
FIG. 2 shows an enlarged cross section through the foaming device of FIG. 1.

Referring to FIG. 2, the containment cylinder 11 forms a space 15 that houses an envelope 16 attached to it by male/female attachment to the base 8 of the closing means 5 of the tank 2.

Attachment of the envelope 16 to the base 8 is via an annular base 19 with an undercut portion 20 engaged with the series of vertical cylindrical walls 8' and annuluses 8" of the base 8 of the closing means 5.

The said annular base 19 and the said undercut portion 20, and also the series of vertical cylindrical walls 8' and annuluses 8", represent a preferred embodiment of means of attachment.

The annular base 19 terminates, in a preferred embodiment of the device 1, in an annular lip 21 which diverges downwards and engages, deforming elastically as it does so, with an annular cavity defined by the series of vertical cylindrical walls 8' and annuluses 8" of the closing means 5. The annular lip 21 forms, in a preferred embodiment, a renewing valve 21' through which the air in the tank is renewed. The said renewing valve 21' for the renewal of air in the tank is a non-limiting example of an embodiment of the means of renewing the air in the tank.

The envelope 16 also includes a resiliently deformable diaphragm 22, preferably cup-shaped, which encloses an air chamber 23, and a tubular core 26, which houses one end of the aspiration tube 6 and is integral with and concentric with the diaphragm 22.

The diaphragm 22 preferably comprises a supporting surface 22' whose shape is essentially that of a flat circular annulus, and a surface 22" which is concave towards the air chamber. The concave surface 22" of the diaphragm 22 is provided with an anchoring ring 24 on the outside edge and an inner ledge 25 not far from the inside edge of the diaphragm 22.

The tubular core 26 is surmounted by a cup-shaped head 27 that acts as a piston 27' for the liquid: said head has a sealing lip 28 with diverging walls and an essentially frustoconical projection 29. The projection 29 contains a cut 30 approximately at right angles to an axis Y—Y of symmetry of the tubular core, which preferably coincides with the axis X—X of symmetry of the tank.

Above the cut 30 is a closing lip 47 integral with the frustoconical projection 29.

The closing lip 47 acts as a non-return valve 46 on a path of aspiration of the liquid 44 that allows communication between the tank 2 and a liquid chamber 42.

Figure 3:
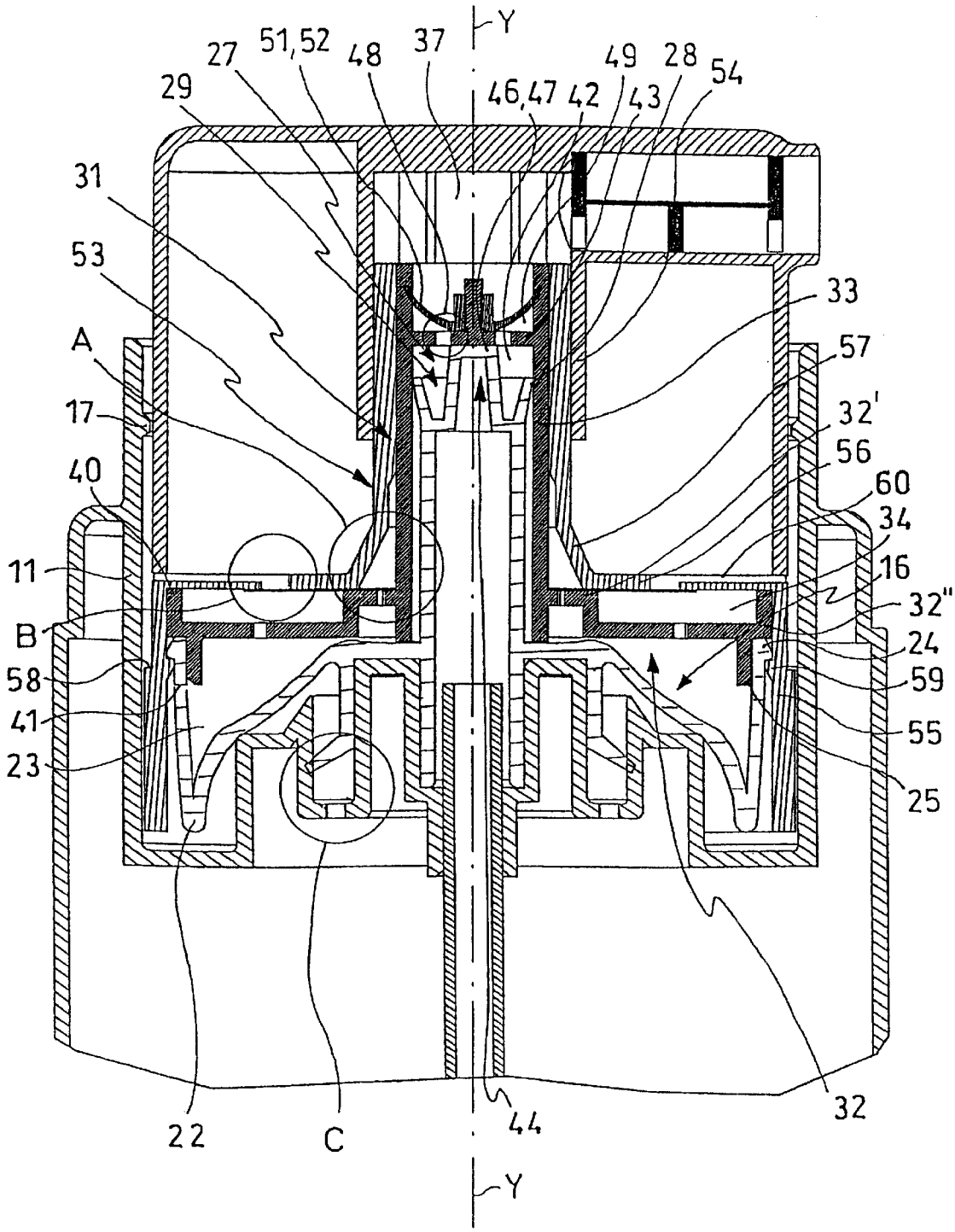
FIG. 3 shows an enlarged cross section through the foaming device of FIG. 1 when deformed at maximum compression.

As shown in FIG. 3, the cup-shaped head 27 of the envelope 16 is functionally connected with an intermediate element 31 comprising an annular band 32 and a liquid cylinder 33, these being preferably made in one piece.

The annular band 32 of the intermediate element 31 comprises, in a preferred embodiment, a first annulus 32' and, concentric and integral with the first annulus 32', a second annulus 32". The annuluses are arranged on parallel planes at different heights.

The second annulus 32" comprises, in another embodiment of the device, an upper annular projection 40 and a lower annular projection 41. The said projections run around the edge of the second annulus 32", the first above and the second below the said second annulus. The lower projection 41 engages with the inside ledge 25 of the diaphragm 22.

The said annular band 32 of the intermediate element 31 provides an annular space 34 bounded by the first annulus 31', the second annulus 32" and the upper annular projection 40.

The annular band 32 contains a plurality of holes 35 for expulsion of the volume of air A' (in FIG. 4), these preferably being in the first annulus 32' and allowing communication between the air chamber 23 and a path of expulsion of the air 36 into a mixing chamber 37 in which the volume of air A' is mixed with the quantity of liquid L'.

Additionally, the annular band 32 contains a plurality of air aspiration holes 38 (in FIG. 5), preferably in the second annulus 32", so that an air aspiration path 39 can communicate with the air chamber 23.

The liquid cylinder 33 contains the liquid chamber 42. This is separated from the air chamber 23 by the sealing lip 28 of the envelope 16 which presses against the walls of the liquid cylinder 33. The liquid chamber 42 is preferably bounded not only by the liquid cylinder 33 and cup-shaped head 27 but also by a transverse expulsion wall 43 at one end of the liquid cylinder 33.

In a preferred embodiment, the cut 30 in the cup-shaped head 27 gives communication between the liquid chamber 42 and the space inside the tubular core 26 of the envelope, through the liquid aspiration path 44.

A non-return valve 46 is positioned on the liquid aspiration path 44. The said non-return valve 46 is produced, in a preferred form of the device 1, by a flexible lip 47 belonging to the cup-shaped head 27 and positioned above the cut 30 and integral with the frustoconical projection 29.

The non-return valve 46 is only a preferred, non-limiting example of means of controlling the flow of liquid during expulsion.

The transverse expulsion wall 43 of the liquid cylinder 33 is preferably pierced by a plurality of holes 48 for expulsion of the liquid and defines, together with a portion of the liquid cylinder 33, a liquid expulsion chamber 49.

The liquid chamber 42 is in communication, via the liquid expulsion holes 48 and a liquid expulsion path 50, with the mixing chamber 37. The liquid expulsion path 50 is separated from the air expulsion path 36 by the liquid cylinder 33, as far as the mixing chamber 37 where the said paths come together.

A liquid expulsion valve 51 is positioned on the liquid expulsion path 50.

The said liquid expulsion valve 51 is preferably a resiliently deformable flap 52 which is housed in the expulsion chamber 49 and provided with elongate walls 52' which press and deform against the walls of the expulsion chamber 49. The liquid expulsion valve 51 described is a preferred, non-limiting example of an embodiment of means of sealing the foam.

In one preferred embodiment, the intermediate element 31 is attached to an essentially hollow air piston 53 comprising a upper cylindrical body 54 and a lower cylindrical body 55, the diameter of the latter being greater than that of the upper cylindrical body 54, and these two bodies 54 and 55 being joined by an annular surface 56. The said upper cylindrical body 54 is preferably joined to the said annular surface 56 by a frustoconical wall 57.

The air piston 53 slides inside and is connected to the containment cylinder 11 by means of a guide projection 58 on the lower cylindrical body 55, on the outside of the latter, which abuts against the stop edge 17 of the containment cylinder 11.

The lower cylindrical body 55 preferably comprises an annular tooth 59 located on the inside of the said lower cylindrical body in abutment with the anchoring ring 24 of the diaphragm 22. The diaphragm 22 is locked, near its edge, between the intermediate element 31 and the air piston 53, by the annular tooth 59 on the air piston 53 in abutment against the anchoring ring 24 of the diaphragm 22, and by the lower annular projection 41 of the intermediate element in abutment against the ledge 25 on the inside of the diaphragm 22.

In a preferred embodiment, the annular surface 56 of the air piston 53 comprises a plurality of essentially radial grooves 60 running from the periphery towards the centre of the said annular surface and interrupted at a plurality of through holes 61 passing through the said annular band.

In another embodiment of the device 1, the through holes 61 (shown in FIG. 5), located on the air aspiration path 39, are intercepted by an air aspiration valve 62, which is typically a second annular portion 63" of a resiliently deformable ring 63. The said ring 63 also includes a first annular portion 63', which intercepts the air expulsion holes 35.

The first portion 63' of the ring 63 acts as an air expulsion valve 64.

The air aspiration valve 62 and the air expulsion valve 64 represent a preferred, non-limiting embodiment, the first as a means of controlling the incoming flow of air and the second as a means of controlling the outgoing flow of air.

With reference to FIG. 1, the air piston 53 is surmounted, in another embodiment of the device 1, by an essentially hollow head 65 comprising, as a minimum, an outer cylindrical wall 66, an inner cylindrical wall 67 (these walls 66 and 67 being preferably concentric), and a transverse pipe 68 that extends essentially at right angles to the axis Y—Y.

The said head 65 is connected to the upper cylindrical body 54 of the air piston 53 by attaching together the upper cylindrical body 54 of the air piston 53 and the inner cylindrical wall 67 of the head 65.

Preferably, the outer cylindrical wall 66 of the head 65 extends down and rests on the annular surface 56 of the air piston 53.

The transverse pipe 68 inside the head 65 can receive a foaming member 69 (FIG. 7) comprising a grid 70 with a plurality of passageways 71 dividing the foaming member 69 into an upper zone 72 and a lower zone 73, the said passageways 71 being such as to allow communication between the said upper zone and the said lower zone.

The foaming member 69 also includes one or more bases 74, each provided with an aperture 75 entirely contained either within the upper zone 72 or within the lower zone 73 of the said foaming member 69.

In addition, the foaming member 69 includes one or more intermediate projections 76 entirely contained either within the upper zone 72 or within the lower zone 73 of the foaming member 69.

The intermediate projection 76 and the transverse pipe 68 define a labyrinth path 77 that passes through the grid at at least two points followed by the quantity of liquid L' mixed with the volume of air A' for complete and uniform generation of the foam.

The device 1 according to the invention is capable of generating foam by mixing the volume of air A' with the quantity of liquid L'.

In the initial or rest configuration of the device 1, illustrated in FIG. 2, the head 65 is in the fully up position in which it is supported by the air piston 53.

The device 1 is permanently being pushed towards the said initial or rest configuration by the diaphragm 22, which is of a resilient material. The said diaphragm 22 exerts a force which, in the initial or rest configuration, pushes the guide projection 58 of the lower cylindrical body 55 towards the stop edge 17 of the containment cylinder 11, supporting the air piston 53 in an upper limit position. The said diaphragm 22 is preferably elastically preloaded, even with the air piston 53 in the said upper limit position.

When the device 1 is used for the first time, the air chamber 23 contains the volume of air A', while the liquid chamber 42 does not contain the quantity of liquid L', which must first be drawn up from the tank 2.

Pushing the head 65 down, generally by hand, against the permanent effect of the cup-shaped diaphragm 22 has the effect of expelling air, but no liquid L' is expelled from the liquid chamber 42 as the latter is initially empty.

When pushed down, the head 65 connected to the air piston 53 moves the said air piston down, in a direction roughly parallel to the axis Y—Y and/or X—X, guided by the containment cylinder 11. The air piston can be moved from the upper limit position, described above, to a lower limit position, in which the lower cylindrical body 55 interferes with the base 8 of the closing means 5.

The air piston 53 also takes down with it the intermediate element 31 which, together with the air piston 53, anchors the edge of the diaphragm 22.

During the movement towards the lower limit position, the air piston 53 and the intermediate element 31 expel the volume of air A' from the air chamber 23.

While the air piston 53 is proceeding downwards, taking the intermediate element 31 with it, the said intermediate element is sliding relative to the liquid piston 27', which remains in a fixed position relative to the tank 2, thus reducing the volume of the liquid chamber 42.

When the head 65 is released, the effect of the cup-shaped diaphragm 22 is to return the device 1 to the initial or rest configuration, following the phases of aspiration of the liquid from the tank 2 into the liquid chamber 42 and of aspiration of air from the environment around the outside of the device 1 into the air chamber 23.

The elastic force of the diaphragm 22 acts on the air piston 53, pushing it upwards and tending to increase the volume of the deformed air chamber 23 and the volume of the liquid chamber 42. The diaphragm 22 acts as elastic means in a preferred and non-limiting embodiment of the device 1.

The tendency to increase the volume of the deformed air chamber 23 and the volume of the liquid chamber 42 generates a depression in the air chamber 23 and a depression in the liquid chamber 42.

The depression in the liquid chamber 42 closes the liquid expulsion valve 51, preventing communication between the liquid chamber 42 and the liquid expulsion path 50, and opens the non-return valve 46, allowing communication between the liquid chamber 42 and the tank 2, via the liquid aspiration path 44.

The depression in the liquid chamber 42 lifts the closing lip 47 of the frustoconical projection 29, which lies over the cut 30, off the said cut 30, giving communication between the liquid chamber 42 and the liquid aspiration path 44, allowing liquid to be drawn from the tank 2 into the liquid chamber 42.

When the head 65 is again depressed, the liquid chamber 42 gradually fills with liquid until it contains a quantity of liquid L' sufficient to generate the foam.

In the initial or rest configuration of the device 1, with the liquid chamber 42 filled with a quantity of liquid L' sufficient to generate foam, downward depression of the head 65 connected to the air piston 53 causes expulsion of the volume of air A' and of the quantity of liquid L'.

Depressing the head 65 depresses the air piston 53, which moves the intermediate element 31. The intermediate element 31 and the air piston 53 clamp the edge of the diaphragm 22 so that the said diaphragm 22 can deform.

As the air piston 53 proceeds towards the lower limit position, the diaphragm 22 deforms. This initially affects that portion of the concave surface 22" of the diaphragm 22 which is next to the supporting surface 22'.

In this initial stage of deformation, the change in the volume of the air chamber 23 is less than the change in the volume of the said air chamber later on in the deformation, when deformation occurs to portions of the concave surface 22" progressively further away from the supporting surface 22' of the diaphragm 22.

Figure 9:
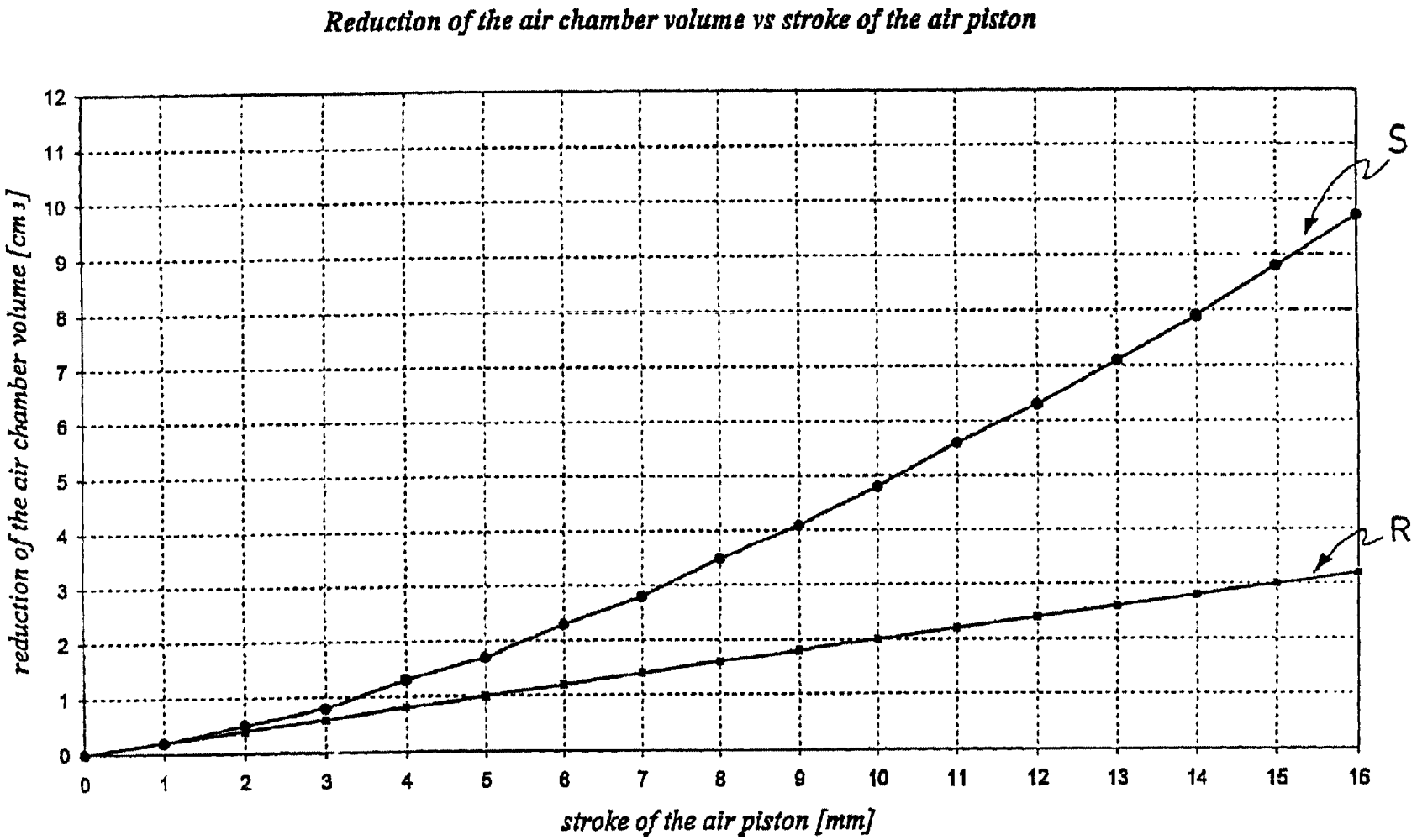
FIG. 9 is a graph showing the reduction in the volume of an air chamber of the foaming device of FIG. 1 or FIG. 8 against the stroke of an air piston of the said device.

As the air piston 53 proceeds downwards, the reduction in the volume of the air chamber 23 increases, as shown by the curve S in FIG. 9. The reduction in the volume of the air chamber 23 coincides with the volume of air expelled.

"Rate of flow of expelled air" here means the variation in the volume of air expelled as a function of the downward displacement of the air piston. Consequently the straight line R in FIG. 9 describes the change in the volume of air expelled by a device with a constant rate of flow of air and the increasing curve S, characteristic of the foaming device 1 according to the invention, describes the change in the volume of air expelled by a device with an increasing rate of flow of air.

The diaphragm 22 deforms elastically under the action of the air piston 53, compressing the air inside the air chamber 23, increasing the pressure of the air in the air chamber 23.

The increased air pressure in the air chamber 23 produces an increased air pressure in the annular space 34 connected to the air chamber 23 through the air aspiration holes 38. This closes the air aspiration valve. In other words the increased air pressure in the space 15 exerts a force on the second portion 63" of the elastic ring 63 against the annular surface 56 of the air piston 53, covering and closing the through holes 61.

The increased pressure of the air in the air chamber 23 opens the air expulsion valve 64, expelling the volume of air A' into the mixing chamber 37 via the air expulsion path 36. In other words, the increased air pressure in the chamber 23 produces a force on the first portion 63' of the elastic ring 63, which deforms elastically away from the first annulus 32' of the annular band 32 of the intermediate element 31, assisted by the space left vacant by the frustoconical wall 57 of the air piston 53.

The convex surface 22" of the diaphragm deforms under the action of the air piston 53 and progressively drapes itself over the base 8 of the closing means 5, shaped generally conically.

As the device 1 changes from the initial or rest configuration to a deformed configuration shown in the situation of maximum deformation in FIG. 3, the convex surface 22" of the diaphragm 22 interferes with the vertical cylindrical walls 8' and the annuluses 8" of the base 8, which guide the said convex surface as it deforms.

In the deformed configuration, the convex surface 22" of the diaphragm 22 is received progressively in recesses 15' of the space 15 between successive vertical cylindrical walls 8'.

The series of vertical cylindrical walls 8' and annuluses 8"—and also the recesses 15' in the space 15, shaped so as to receive, in the deformed configuration of the device, the diaphragm 22 or portions of this diaphragm such as the convex surface 22"—represent a preferred and non-limiting embodiment of means for increasing the rate of flow of expelled air.

As the air piston 53 proceeds downwards, the intermediate element 31 slides relative to the liquid piston 27', which remains in a fixed position with respect to the tank 2, reducing the volume of the liquid chamber 42 and increasing the pressure of the liquid in the liquid chamber 42. The sealing lip 28 of the tubular core 26 stays pressed against the walls of the liquid cylinder 33.

The liquid passes through the liquid expulsion holes 48 into the expulsion chamber 49 and the increased pressure of the liquid in the liquid chamber 42 generates an increase in the pressure of the liquid in the expulsion chamber 49. The increase of the pressure of the liquid in the expulsion chamber 49 opens the liquid expulsion valve 51. In other words, the increase in the pressure of the liquid in the expulsion chamber generates a force which lifts the elongate walls 52' of the flap 52 off the walls of the expulsion chamber, allowing the liquid to reach the mixing chamber 37.

The increased pressure of the liquid in the liquid chamber 42 closes the non-return valve 46. The increased pressure of the liquid elastically deforms the closing lip 47 of the frustoconical projection 29, closing the cut 30 and preventing communication between the liquid aspiration path 44 and the liquid chamber 42.

During the period of expulsion of the liquid and air, the quantity of liquid L' and the volume of air A' pass along the liquid expulsion path 50 and the air expulsion path 35, respectively, remaining unmixed until they reach the mixing chamber 37, in which the liquid expulsion path 50 and air expulsion path 35 come together.

The movement of the air and liquid through the foaming member 69 generates the foam which escapes into the environment outside the device 1 through the transverse pipe 68. Inside the foaming member 69, the volume of air A' and the quantity of liquid L' mix intimately along a labyrinth path 77 in which they cross the grid 70 with its passageways 71 one or more times.

When the head 65 is released, the device 1 returns to the initial or rest configuration, following aspiration of liquid from the tank 2 and aspiration of air from the environment outside the device into the air chamber 23.

The elastic force of the deformed diaphragm 22 pushes the air piston 53 upwards, tending to increase the volume of the air chamber 23 and of the liquid chamber 42.

The tendency to increase the volume of the air chamber 23 generates a depression of the air in this chamber.

The depression of the air in the air chamber 23 opens the air aspiration valve 62, allowing communication between the environment outside the device and the air chamber 23 via the air aspiration path 39. In other words the depression of the air in the air chamber 23 lifts the second portion 63" of the elastic ring 63 off the annular surface 56 of the air piston 53 and uncovers the through holes 61. The second portion 63" of the elastic ring 63 deforms and is received in the annular space 34 of the intermediate element 31.

The depression of the air in the air chamber 23 closes the air expulsion valve 64 and prevents communication between the air mixing chamber 37 and the air chamber 23 via the air expulsion path 36. In other words the depression of the air in the air chamber 23 presses the first portion 63' of the elastic ring 63 against the first annulus 32' of the intermediate element 31, closing the air expulsion holes 35.

At the same time the elastic force of the diaphragm 22 moves the intermediate element 31 upwards, which tends to increase the volume of the liquid chamber 42. The tendency of the volume of the liquid chamber 42 to increase generates a depression in this chamber.

The depression inside the liquid chamber 42 is transmitted to the expulsion chamber 49, which closes the liquid expulsion valve 51 and prevents communication between the liquid chamber 42 and the mixing chamber 37, via the liquid expulsion path 50. In other words the elongate walls 52' of the flap 52 press against the walls of the expulsion chamber 49 and prevent communication between the liquid chamber 42 and the liquid expulsion path 50.

The flap 52 with its elongate side walls 52' is a preferred and non-limiting embodiment of means of sealing the foam.

Aspiration of liquid from the tank 2 generates a depression in the said tank 2 which opens the air renewal valve 21' and draws air in from the environment outside the device 1 into the tank 2 via the air renewal path 10.

The depression in the tank 2 lifts the annular lip 21 of the annular base 19 of the envelope 16 off one of the vertical cylindrical walls 8' of the base 8 of the closing means 5, allowing communication between the tank 2 and the environment outside the device 1 via the air renewal holes 9 and the air renewal path 10.

Unusually, in the device 1 according to the invention, all of the quantity of air expelled from the air chamber 11 is mixed with the quantity of liquid. In other words the rate of flow of air when the diaphragm 22 first begins to deform is small enough for it to remain completely trapped by the liquid. As actuation of the device continues, the rate of flow of expelled air increases with displacement of the air piston, and continues to be sufficient for foam generation.

Furthermore, the device 1 according to the invention is able to expel practically the whole of the volume of air A' present in the air chamber 23 when the latter is in its initial or rest configuration.

Further, the device 1 according to the invention exhibits the advantage of possessing a simplified structure which facilitates manufacture of the device and improves the operations of assembly of its component parts. In other words the device 1 consists of a small number of components but still generates foam effectively.

It is an advantage that the device 1 according to the invention is not subject to deterioration of its parts by the action of chemical attack on metal parts and such like by the foam-generating liquid employed.

Also, the structure of the device 1 avoids the contamination of the air chamber during use of the device with residues of liquid or previously formed foam and, at the same time, avoids contamination of the tank with foam. Additionally, no liquid is entrained outwards during use of the device or during transport.

Lastly, the structure of the device 1 makes the assembly rigid, in such a way that there is no looseness in the connections between the parts.

Figure 8:
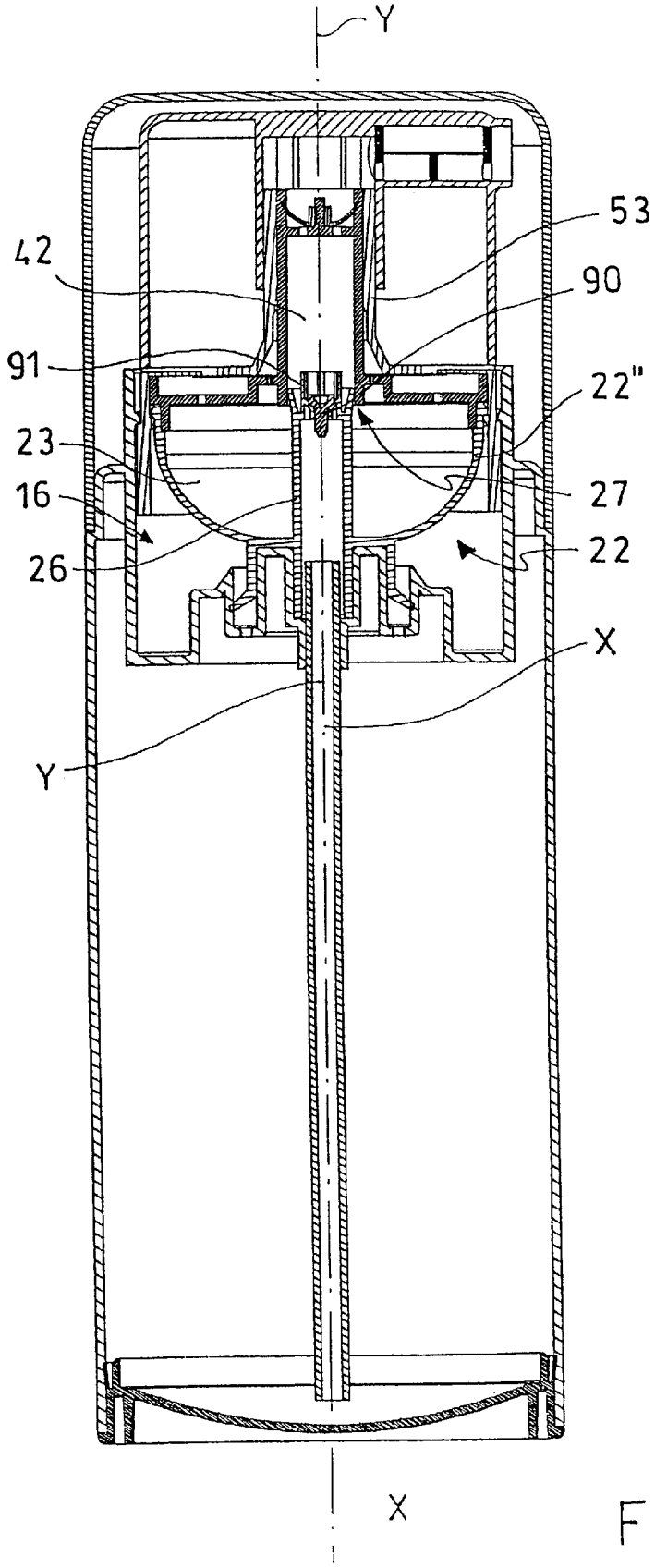
FIG. 8 shows a cross section through another embodiment of the foaming device, fitted to the tank and with the cap.

In another embodiment of the device 1 (FIG. 8), the cup-shaped head 27 of the tubular core 26 of the envelope 16 receives a moving part 90 capable of moving between a configuration of abutment against the tubular core 26 and a raised configuration in abutment against an end stop 91 on the cup-shaped head 27.

The non-return valve 46 comprises, in the other embodiment of the device 1, the end stop 91 and the moving part 90.

Clearly, a person skilled in the art could, in order to satisfy contingent and particular needs, make numerous modifications and alterations to the foaming device described above that would all remain within the scope of protection of the invention as defined by the following claims.

What is claimed is:

1. A foaming device capable of generating foam by mixing a volume of air with a quantity of liquid, the device being connectable to a tank of the liquid and comprising:

a resiliently deformable diaphragm enclosing an air chamber capable of containing the volume of air that is to be mixed with the quantity of liquid, the resiliently deformable diaphragm being capable of changing from a rest configuration of the device to a deformed configuration of compression of the device for expulsion of the volume of air;

a liquid chamber capable of containing the quantity of liquid that is to be mixed with the volume of air, the liquid chamber being capable of changing from a rest configuration of the device, in which it defines maximum volume, to the deformed configuration of maximum compression of the device in which it defines a minimum volume, wherein the resiliently deformable diaphragm is shaped in such a way as to bring about, an increasing rate of flow of expelled air from the air chamber as the device changes from the rest configuration to the deformed configuration of compression.

2. A device according to claim 1, also comprising means for increasing the rate of flow of expelled air.

3. A device according to claim 2, in which the means for increasing the rate of flow of expelled air are such as to assist the emptying of the air chamber.

4. A device according to claim 3, in which the means for increasing the rate of flow of expelled air comprise recesses that receive the diaphragm in the deformed configuration of compression of the device.

5. A device according to claim 4, in which the recesses are defined by vertical cylindrical walls.

6. A device according to claim 5, in which the vertical cylindrical walls help to receive the diaphragm in the recesses in the deformed configuration of compression of the device.

7. A device according to claim 6, in which the means for increasing the rate of flow of expelled air are included in tank closing means.

8. A device according to claim 1, in which the device is permanently stressed towards the initial or rest configuration.

9. A device according to claim 8, in which the device is permanently stressed towards the initial or rest configuration by resilient means.

10. A device according to claim 9, in which the resilient means comprise the diaphragm.

11. A device according to claim 1, in which the air chamber and the liquid chamber are placed in communication with a mixing chamber, where the mixing occurs between the volume of air and the quantity of liquid, via an air expulsion path and a liquid expulsion path, respectively.

12. A device according to claim 11, in which the air expulsion path is separated from the liquid expulsion path as far as the mixing chamber.

13. A device according to claim 12, in which the air expulsion path is separated from the liquid expulsion path by an intermediate element.

14. A device according to claim 13, in which a liquid cylinder of the intermediate element defines the liquid chamber.

15. A device according to claim 1, comprising a liquid piston that defines the liquid chamber at its maximum volume in the rest configuration and at its minimum volume in the deformed configuration of maximum compression of the device.

16. A device according to claim 15, in which the liquid piston maintains a fixed position with respect to the tank between the rest configuration and the deformed configuration of compression of the device.

17. A device according to claim 16, in which the diaphragm and the liquid piston are made in one piece.

18. A device according to claim 1, in which the diaphragm is essentially cup-shaped.

19. A device according to claim 1, in which the diaphragm forms a male/female attachment with an air piston and an intermediate element.

20. A device according to claim 19, in which the male/female attachment forms an air seal between the diaphragm and the air piston.

21. A device according to claim 20, in which the male/female attachment of the diaphragm comprises an anchoring ring and a ledge on the inside of the diaphragm, the first being attached to an annular tooth on the air piston and the second to a lower annular projection on the intermediate element.

22. A device according to claim 1, in which the diaphragm is connected to a base by means of attachment.

23. A device according to claim 22, in which the means of attachment form a male/female attachment between the diaphragm and the base.

24. A device according the claim 23, in which the male/female attachment is formed by at least one annular base integral with the diagram and projecting from the diaphragm.

25. A device according to claim 22, in which base forms tank closing means.

26. A device according to claim 11, comprising means of controlling the expulsion of the volume of air from the air chamber to the mixing chamber, located on the air expulsion path.

27. A device according to claim 26, in which the means of controlling the expulsion of the volume of air comprise an air expulsion valve that allows the volume of air to be expelled from the air chamber into the mixing chamber and prevents the foam from being drawn from the mixing chamber to the air chamber.

28. A device according to claim 27, in which the air expulsion valve is formed by a first portion of a deformable resilient ring.

29. A device according to claim 11, comprising means of controlling the aspiration of the volume of air from the environment outside the device into the air chamber, which means are located on an air aspiration path leading from the environment outside the device to the air chamber.

30. A device according to claim 29, in which the means of controlling the aspiration of the volume of air comprise an air aspiration valve that allows aspiration of the volumes of air from the environment outside the device to the air chamber.

31. A device according to claim 30, in which the air aspiration valve is formed by a second portion of a deformable resilient ring.

32. A device according to claim 31, in which the second portion of the resilient ring is received, in a deformed configuration, in an annular space provided in an intermediate element.

33. A device according to claim 11, comprising an air expulsion valve that allows the volume of air to be expelled from the air chamber into the mixing chamber and prevents foam from being drawn from the mixing chamber to the air chamber, and an air aspiration valve that allows the volume of air to be drawn in from the environment outside the device to the air chamber and prevents air from being expelled from the air chamber to the environment outside the device, in which the air expulsion valve and the air aspiration valve are made in one piece.

34. A device according to claim 33, in which the air expulsion valve and the second air aspiration valve are formed by a resiliently deformable ring.

35. A device according to claim 11, comprising foam sealing means on the liquid expulsion path.

36. A device according to claim 35, in which the foam sealing means comprise a liquid expulsion valve that allows an outflow of the liquid from the liquid chamber to the mixing chamber and prevents foam from being drawn from the mixing chamber into the liquid chamber.

37. A device according to claim 36, in which the liquid expulsion valve comprises a flap.

38. A device according to claim 37, in which the flap is provided with elongate walls that press against the walls of a liquid expulsion chamber that receives it, that the expulsion chamber being defined by an intermediate element and situated on the liquid expulsion path, in communication with the liquid chamber and with the mixing chamber.

39. A device according to claim 1, provided with means, located on a liquid aspiration path, of non-return of the liquid.

40. A device according to claim 39, in which the means of non-return of the liquid comprise non-return liquid valve for preventing return from the liquid chamber to the tank and permit aspiration of the liquid from the tank to the liquid chamber.

41. A device according to claim 40, in which the non-return liquid valve is formed in one piece with a liquid piston that defines the liquid chamber at its maximum volume in the rest configuration and at its minimum volume in the deformed configuration of maximum compression of the device.

42. A device according to claim 41, in which the non-return liquid valve comprises a cut down through the liquid piston that allows communication between the liquid chamber and the mixing chamber and a closing lip which, in a deformed configuration of the lip, bends down onto the cut.

43. A device according to claim 1, comprising a liquid piston that defines the liquid chamber at its maximum volume in the rest configuration and at its minimum volume in the deformed configuration of maximum compression of the device, a valve for non-return of the liquid from the liquid chamber to the tank, which prevents return of the liquid from the liquid chamber to the tank and permits aspiration of the liquid from the tank to the liquid chamber, this valve being made in one piece with the diaphragm and the liquid piston.

44. A device according to claim 1, comprising means, located on an air renewal path, for renewing the air in the tank.

45. A device according to claim 44, comprising a valve for renewing the air in the tank that allows aspiration of air from the environment outside the device to the tank and prevents, in the rest configuration of the device, entrainment of liquid from the tank to the environment outside the device.

46. A device according to claim 45, in which the valve for renewing air in the tank includes an annular lip.

47. A device according to claim 46, in which the annular lip is received between at least two vertical cylindrical walls forming part of a base that supports the diaphragm, these vertical cylindrical walls being arranged in a series.

48. A device according to claim 1, comprising a liquid piston that defines the liquid chamber at its maximum volume in the rest configuration and at its minimum volume in the deformed configuration of maximum compression of the device, a valve for renewing the air in the tank, that allows aspiration of air from the environment outside the device to the tank and prevents, in the rest configuration of the device, entrainment of liquid from the tank to the environment outside the device, and a valve for non-return of the liquid from the liquid chamber to the tank, which prevents return of the liquid from the liquid chamber to the tank and permits aspiration of the liquid from the tank to the liquid chamber, the renewal valve and the non-return valve being made in one piece with the resiliently deformable diaphragm and the liquid piston.

49. A device according to claim 12, comprising a sealing lip that slides inside the intermediate element and stays pressed against the intermediate element, providing an airtight and liquidtight seal between the liquid chamber and the air chamber.

50. A device according to claim 49, in which the sealing lip is made in one piece with the diaphragm and with a liquid piston, which defines the liquid chamber at its maximum volume in the rest configuration and at its minimum volume in the deformed configuration of maximum compression of the device.

51. A device according to claim 1, comprising a liquid piston that defines the liquid chamber at its maximum volume in the rest configuration and at its minimum volume in the deformed configuration of maximum compression of the device, a sealing lip that slides inside the intermediate element and stays pressed against the intermediate element, separating the liquid chamber leaktightly from the air chamber, a non-return liquid valve that prevents return of the liquid from the liquid chamber to the tank and permits aspiration of the liquid from the tank to the liquid chamber, the sealing flap and the non-return liquid valve being made in one piece with the liquid piston and the diaphragm.

52. A device according to claim 1, comprising a liquid piston that defines the liquid chamber at its maximum volume in the rest configuration and at its minimum volume in the deformed on figuration of maximum compression of the device, a sealing lip that slides inside an intermediate element and stays pressed against the intermediate element, separating the liquid chamber leaktightly from the air chamber, a non-return liquid valve that prevents return of the liquid from the liquid chamber to the tank and permits aspiration of the liquid from the tank to the liquid chamber, and a valve for renewing the air in the tank, which permits aspiration of air from the environment outside the device to the tank and prevents, in the rest configuration of the device, entrainment of liquid from the tank to the environment outside the device, the sealing lip, the non-return liquid valve and the valve for renewing the air in the tank all being made in one piece with the liquid piston and the diaphragm.

53. A device according to claim 1, comprising an air piston designed to deform the diaphragm, the air piston being abutment, in the rest configuration of the device, against a stop edge on a containment cylinder, so that the diaphragm is elastically preloaded.

54. A device according to claim 11, comprising, located inside the mixing chamber, a foaming member designed to mix the volume of air and the quantity of liquid in order to generate the foam.

55. A device according to claim 54, in which the foaming member comprises a grid functionally connected to at least one lateral base provided with an aperture.

56. A device according to claim 55, in which the foaming member comprises a plurality of intermediate projections.

57. A device according to claim 54, in which the foaming member comprises a grid functionally connected to at least one lateral base provided with an aperture and a plurality of intermediate projections, the projections forming a labyrinth path that passes through the grid at one or more points.

58. A device according to claim 1, wherein the rate of flow of expelled air from the air chamber increases progressively as the device changes from the rest configuration to the deformed configuration o compression.

* * * * *